United States Patent [19]

Haglund

[11] 4,240,512

[45] Dec. 23, 1980

[54] ARRANGEMENT FOR GUIDING A BORE-CROWN OR BIT ALONG A GIVEN PATH

[76] Inventor: Mats T. Haglund, Malmstavägen 25, S-971 00 Malmberget, Sweden

[21] Appl. No.: 14,975

[22] Filed: Feb. 26, 1979

[30] Foreign Application Priority Data

Mar. 6, 1978 [SE] Sweden ..... 7802488

[51] Int. Cl.[3] ..... E21B 7/08

[52] U.S. Cl. ..... 175/75; 175/61

[58] Field of Search ..... 175/73, 75, 79, 81, 175/61, 171, 173

[56] References Cited

U.S. PATENT DOCUMENTS

| | | | |
|---|---|---|---|
| 550,783 | 12/1895 | Elliott et al. | 175/75 |
| 2,292,126 | 8/1942 | Isley | 175/171 X |
| 2,516,421 | 7/1950 | Robertson | 175/173 X |
| 2,644,669 | 7/1953 | Curtis et al. | 175/61 X |
| 2,669,428 | 2/1954 | Zublin | 175/75 |
| 2,669,429 | 2/1954 | Zublin | 175/75 X |
| 3,260,318 | 7/1966 | Neilson et al. | 175/75 |
| 3,526,285 | 8/1970 | Adkins et al. | 175/73 |
| 3,903,974 | 9/1975 | Cullen | 175/61 X |
| 4,143,722 | 3/1979 | Driver | 175/61 X |

FOREIGN PATENT DOCUMENTS

| | | | |
|---|---|---|---|
| 657749 | 5/1929 | France | 175/75 |
| 1247454 | 10/1960 | France | 175/79 |
| 20611 | of 1908 | United Kingdom | 175/75 |

*Primary Examiner*—James A. Leppink
*Assistant Examiner*—Richard E. Favreau
*Attorney, Agent, or Firm*—Kinzer, Plyer, Dorn & McEachran

[57] ABSTRACT

An arrangement for guiding a drill crown or bit (8) (FIG. 4) in a given drilling path comprises an outer guide tube (7) in which a shaft (6) is rotatably arranged. The shaft is driven by a drive means (5) connected to one end of the shaft, while the bit (8) is mounted for rotation on and guided by the other end of said shaft. The axis of rotation (9) of the bit forms an angle ($\alpha$) with the central axis (10) of the guide tube, said tube being non-rotatably, but axially displaceably connected to an axially feeding device through intermediate means (11).

4 Claims, 4 Drawing Figures

ARRANGEMENT FOR GUIDING A BORE-CROWN OR BIT ALONG A GIVEN PATH

Figure 1:
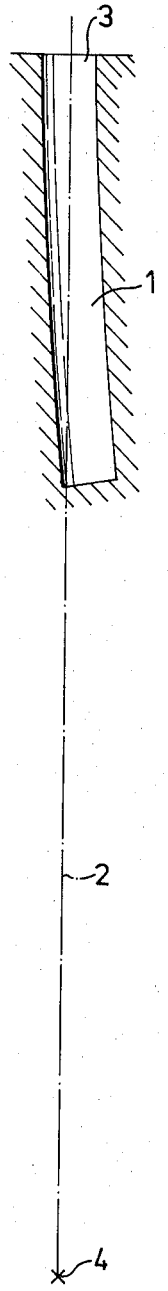

The present invention relates to an arrangement for guiding a drill crown or bit in a given curved path when drilling holes in rock or in the ground, comprising an outer guide tube, a shaft arranged for rotation in said guide tube, the shaft having one end thereof connected to a drive means and carrying the crown or bit on its other end, the axis of rotation of said crown or bit forming an angle with the centre axis of the guide tube.

When drilling long holes in rock or similar ground for the purpose of prospecting after ores, gas or oil, or when drilling such holes for burying electrical cables for example, which shall be led to underground consumer stations, it is always difficult to lead the holes directly onto a given target. The extent to which these holes deviate from the said given target is normally quite considerable and it is very seldom that the holes are completely straight.

Different methods and apparatus have been proposed for the purpose of counteracting or eliminating deviations from a straight line when drilling such holes, but the result has not been satisfactory in the case of long drill-holes.

Consequently, the fact that the holes will deviate to quite some extent from a straight line has been accepted, and one has concentrated on the manufacture of apparatus which will enable the drill hole to be corrected in a manner such as to reach the target.

One such apparatus arranged to produce holes which are purposely curved is described in the U.S. Pat. No. 2,631,820.

This known apparatus is based on the use of a flexible outer guide tube and an inner, flexible drive shaft and a bore crown or bit which has been ground in a special manner. The axis of rotation of the bore crown or bit is tangential to the curved drill hole. It is not possible with such an apparatus to guide the path travelled by the crown or bit positively and specifically, since the bore crown, from a theoretical viewpoint, must continue in the tangential direction. The deviations which occur are caused by the same conditions as those deviations which occur when drilling with conventional apparatus, e.g. as a result of inhomogenieties in the rock or ground.

It is therefore a prime object of the present invention to provide an arrangement of the type mentioned in the introduction which will permit holes to be drilled in a given path and to allow unintentional deviations in an uncompleted hole to be corrected. A further object of the invention is to provide an arrangement by means of which drill holes extending from a central drill hole can be made in given directions, for example when examining sand layers or the like in oil-prospecting operations.

These objects are realized with an arrangement of the aforedescribed type in which the axis of rotation of the bore crown or bit forms an angle with the center axis of the guide tube.

When correcting a curved drill-hole in order to direct it towards the intended target, an arrangement according to the invention is inserted in the drill hole with the axis of rotation of the bore crown directed towards the target, whereafter the hole is drilled further until the requisite, correction in the curve has been obtained, whereafter drilling is continued with conventional drilling equipment. Subsequent deviations are corrected in a corresponding manner.

Figure 2:
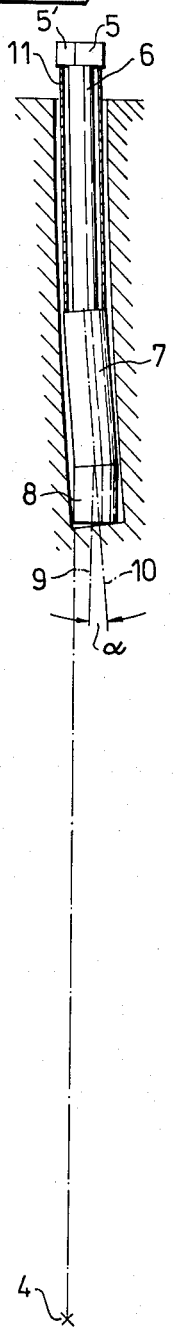
Figure 3:
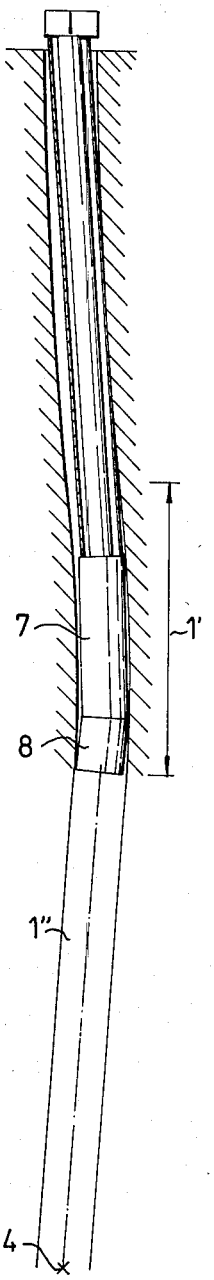
Figure 4:
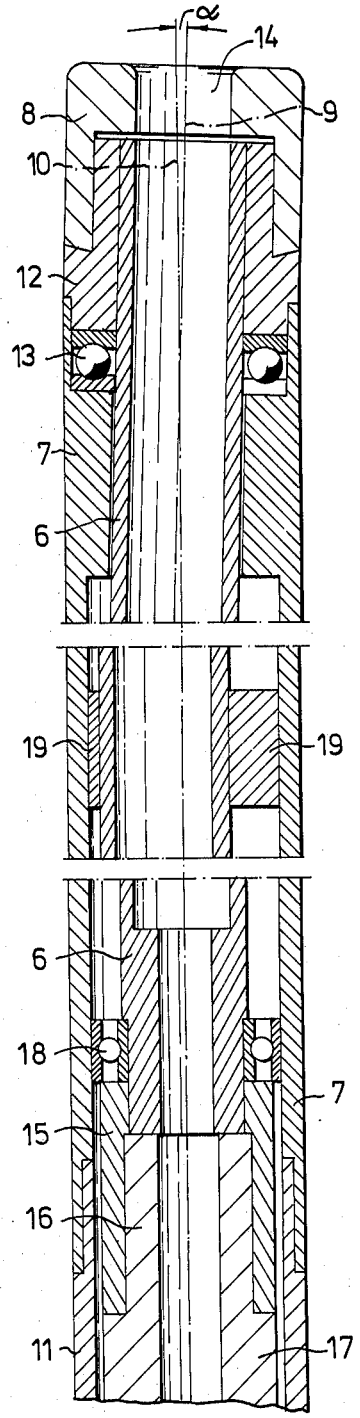

So that the invention will be more readily understood and further features thereof made apparent, an exemplary embodiment of the invention will now be described with reference to the accompanying drawings, in which FIG. 1 illustrates a drill hole formed by means of conventional drilling equipment and which deviates from a given, straight line from the mouth of the hole to the target, FIG. 2 illustrates how an arrangement according to the invention is inserted in the drill hole of FIG. 1, FIG. 3 illustrates how the hole is corrected in a directional sense by means of the arrangement according to the invention, and FIG. 4 is a sectional view of the arrangement according to the invention.

FIG. 1 illustrates a drill hole 1 which has been drilled with conventional drilling equipment and which deviates from a desired straight line 2 extending between the mouth 3 of the drill hole and the intended target 4. For the purpose of correcting the curve in the hole 1, there is inserted in said hole an arrangement according to the invention, as illustrated in a greatly simplified manner in FIG. 2. The arrangement according to the invention comprises a conventional drive means 5 having a drive shaft 6 which passes through a cylindrical guide tube 7 and which carries at its lower end, as seen in the drawing, a bore crown or bit 8 comprising, for example, a diamond bore-crown or some other suitable type of bore crown having a diameter which is slightly greater than the diameter of the cylindrical guide tube 7. The bore-crown 8 is rotated and forced axially along the guide tube by means of the drive shaft 6. In accordance with the invention the axis 9 of rotation of the bore-crown 8 is positioned obliquely relative to the center axis 10 of the substantially rigid guide tube 7 and forms therewith an angle $\alpha$. The angle $\alpha$ may vary in dependence upon the deviation to be corrected and may, for example lie within the range of 0.1°–1.5°, although other angles are also conceivable. Extending around the drive shaft 6 and firmly connected to the guide tube 7 is a casing tube 11, as indicated, the upper end of which is held stationary and, in the illustrated embodiment, is considered to be fixed to the feed means 5' of the drive means 5. The object of the casing tube 11, which may comprise mutually joined sections, is partly to prevent stones and the like from reaching the drive shaft and partly to prevent rotation of the guide tube 7.

Because the guide tube 7 is held in a non-rotatable position, it is ensured that the rotary axis 9 of the bore-crown will constantly be held in a given direction. When inserting the arrangement into the drill hole 1, the rotary axis 9 of the bore crown is oriented in a given direction such as to correct the curvature of the drill hole and to correctly align the hole with the target 4, subsequent to drilling a little further. FIG. 3 illustrates the drill hole subsequent to commencing drilling with the arrangement according to the invention. It will be apparent that the bore crown 8, whilst drilling the part 1' of the hole has swung in towards the line 2 in a well defined curved path determined by the angle $\alpha$ and that subsequent to removing the arrangement according to the invention and inserting conventional drilling equipment into the hole 1,1', i.e. drilling equipment in which the rotary axis of the bore-crown coincides with the center axis of the guide tube, a straight hole 1'' can be expected. Should the hole deviate from said straight line when drilling the portion 1″ of said hole, the arrangement according to the invention is again inserted into the hole with the bore-crown oriented in a manner such as to correct the deviation.

An exemplary embodiment of an arrangement according to the invention is illustrated in FIG. 4. In the figure, the guide tube 7 and the drive shaft 6 are divided into three sections. The guide tube 7 may have any convenient length, such as 1.5 meters or lengths which are greater or smaller than this value. In the illustrated embodiment the drive shaft 6 comprises a so-called core tube, which is non-rotatably connected at one end to a spindle 12 which is pivotably mounted in one end of the guide tube 7 and which cooperates with an axial bearing 13. The spindle 12 may be fitted to one end of the core tube 6 by means of a press-fit or a screw thread or in any other suitable manner. Non-rotatably mounted on the spindle 12 by means not shown in a bore-crown 8, which in the illustrated embodiment is taken to be a diamond bore-crown. The bore-crown 8 has a central opening 14 which communicates with the interior of the core tube 6. Water for rinsing away material around the bore-crown 8 is passed through the core tube 6. The other end of the core tube 6 is provided with a sleeve 15 having, for example, a hexagonal cavity for receiving the end 16 of a drill rod 17 couple to the drive means 5. Thus, when the drill rod 17 rotates the core tube 6 will also rotate to drive the spindle 12 and the bore-crown 8, whilst the guide tube 7, which is non-rotatably connected to the casing tube 11, is held stationary. In the illustrated embodiment, the oblique positioning of the core-crown 8 relative to the center axis 10 of the guide tube 7, which is straight in its unloaded state, is obtained by the fact that the core tube 6 is held curved through the bearing in the guide tube in a manner such that the rotary axis 9 of the bore-crown and the axis of the spindle 12 form said angle $\alpha$ with the center axis 10 of the guide tube.

For the purpose of providing the desired curve of the core tube 6, said core tube is journalled at three locations in the guide tube 7. The first location which lies nearest the spindle 12 and the bore-crown 8 is defined by the ball bearing 13 which supports the outer end of the core tube. The other end of the core tube 6 is journalled in a ball bearing device 18. The two ball bearings 13 and 18 hold the ends of the core tube centered relative to the guide tube. The center part of the core tube 6 is journalled in an eccentric slide bearing 19 which holds the core tube curved in a given manner and thus determines the direction in which the rotary axis 9 of the bore-crown 8 extends relative to the center axis 10 of the guide tube 7.

When drilling with the aforedescribed arrangement, the bore-crown 8 will describe a curved drill path in the plane passing through the axes 9 and 10, said curved path deviating from the center line of the guide tube through an angle $\alpha$ at each moment.

The described embodiment of the invention can be modified within the scope of the claims. Thus it is possible to use any suitable type of bore-crown and constructions other than those described in order to hold the bore-crown obliquely relative to the guide tube. For example, it is possible to journal the bore-crown on the guide tube in an oblique position and to use a flexible drive shaft for supplying said rotary movement and the pressure force against the bore-crown. The illustrated and described casing tube 11, one purpose of which is to hold the guide tube against rotation, can be replaced with gripping means mounted on the guide tube itself, said gripping means being intended to dig into the wall of the drill hole so as to prevent rotation, whilst at the same time permitting axial movement of the guide tube.

Although the drive means 5 has been assumed to be stationarily arranged on the surface of the ground, e.g. in a drilling tower, it may also comprise a so-called sink-drill which may be incorporated in the guide tube in a manner such as to accompany the tube down into the hole.

I claim:

1. A drilling assembly for use in earth and rock to correct misalignment of a drilled hole, including:
   - an outer non-rotatable guide tube,
   - a drive shaft rotatably mounted in the outer guide tube,
   - a drill bit connected to one end of the drive shaft and journalled on the outer guide tube,
   - a drill rod connected to the opposite end of the drive shaft,
   - the axis of rotation of the drill bit being angularly offset relative to the longitudinal axis of the outer guide tube, and
   - the longitudinal axis of the drill bit end of the drive shaft being aligned with the axis of rotation of the drill bit,
   - said drive shaft being bent relative to the outer guide tube with the drill rod end of the drive shaft being co-axial with the outer guide tube and the intermediate portion of the drive shaft being eccentrically journalled in the outer guide tube.

2. The drilling assembly of claim 1 in which the drive shaft is flexible.

3. The drilling assembly of claim 1 in which a casing tube is fastened to the outer guide tube to prevent rotation thereof during drilling.

4. The drilling assembly of claim 1 in which a spindle forms the mounting between the outer guide tube and the drill bit with the spindle being journalled on the outer guide tube.

* * * * *